United States Patent [19]

Norman

[11] Patent Number: 4,610,603

[45] Date of Patent: Sep. 9, 1986

[54] PROTECTIVE CONTROL SYSTEM FOR DIFFUSION PUMP

[75] Inventor: Arthur E. Norman, Northridge, Calif.

[73] Assignee: Torr Vacuum Products, Inc., Simi Valley, Calif.

[21] Appl. No.: 280,545

[22] Filed: Jul. 6, 1981

[51] Int. Cl.[4] ..... F04F 9/00

[52] U.S. Cl. ..... 417/154; 219/272; 219/275; 236/94

[58] Field of Search ..... 417/152–154, 417/54, 55; 219/272, 275, 328; 236/94, 21 R, 21 B

[56] References Cited

U.S. PATENT DOCUMENTS

| | | | |
|---|---|---|---|
| 2,903,181 | 9/1959 | Giepen | 417/154 |
| 3,282,330 | 11/1966 | Landfors | 417/208 X |
| 3,362,623 | 1/1968 | Landfors | 417/154 |
| 4,063,974 | 12/1977 | Fraas | 219/275 X |
| 4,108,576 | 8/1978 | Landfors | 417/154 X |
| 4,140,438 | 2/1979 | Landfors | 417/154 X |
| 4,191,512 | 3/1980 | O'Neal, III et al. | 417/154 X |

FOREIGN PATENT DOCUMENTS

| | | | |
|---|---|---|---|
| 1331467 | 5/1963 | France | 417/153 |

*Primary Examiner*—Edward K. Look
*Attorney, Agent, or Firm*—Keith D. Beecher

[57] ABSTRACT

A control system for a diffusion pump is provided which serves to protect the pump from loss of the pumping fluid, from loss of water cooling, as well as from overheating of the heater. The protective system includes a thermally responsive switch mounted on a heat-conductive bracket, and which responds to the temperature of the cooling water as well as to heat radiated from the heater to turn off the electric current to the heater when either the temperature of the cooling water or the heat radiated from the heater rises above a predetermined value. The control system also includes a heater block surrounding the heater, and which is composed of a material having a relatively low melting point as compared with the melting point of the material forming the containment vessel of the pump, so that overheating of the heater will cause the block to melt and to be displaced from the bottom of the containment vessel to reduce heat transfer to the pump. The control system also includes a further vessel filled with heat insulation material surrounding the boiler at the bottom of the containment vessel to minimize heat transfer from the heater to the cooling coils of the pump.

7 Claims, 6 Drawing Figures

PROTECTIVE CONTROL SYSTEM FOR DIFFUSION PUMP

BACKGROUND

A vacuum pump is a device for reducing the pressure of a gas, such as air, within a container below atmospheric pressure so as to increase the vacuum within the container. In practice, where high vacuum is required, two or more pumps are often used in series. For example, a rotary air seal pump may be used in conjunction with a diffusion pump to provide continuity in pumping from atmospheric pressure to a high vacuum range.

Conventional diffusion pumps known in the art are generally comprised of a multi-stage nozzle system, a cylindrical vessel containing the nozzle system and, oftentimes, baffling material to prevent back diffusion. The normal manner of operating diffusion pumps of the type known in the art is to create jets of a pumping liquid (liquids most commonly used being oil or mercury vapor) which strike the water-cooled wall of the vessel and collect in a pool in a boiler at the lowermost portion of the diffusion pump. In this process molecules above the jet streams are trapped in the jet streams and carried out of the pump, thereby evacuating the chamber above the pump.

The working fluid in the diffuser pump is vaporized in a boiler at the bottom of the containment vessel by an electric heater, and it is usual in the prior art to provide a thermostat switch in circuit with the heater to protect the pump from excessive heating. However, as pointed out in U.S. Pat. No. 3,282,330, the usual prior art thermostat control is not responsive to all of the different ways in which the diffusion pump may malfunction.

Specifically, there are three major ways in which the diffusion pump may malfunction, these being: failure in the circulation of cooling water through the coils surrounding the pump containment vessel; excessive pressure rise within the pump, and loss of the working fluid within the pump.

The usual prior art thermostat control systems consist of a thermal switch mounted on a boiler plate forming the bottom of the boiler, and this switch responds only to a rise in the temperature of the boiler plate. With such a prior art protective system, although the thermostat will respond if the wall cooling means fails, its response to the other two sources of malfunction of the pump are less certain.

In the system described in U.S. Pat. No. 3,282,330, the thermal switch is made to be more responsive to the various possible malfunctions of the pump. This is achieved by mounting the thermal switch on an elongated thermal conductor. The conductor is connected at one end to the cooling coils of the pump, and is connected at its other end to the boiler plate at the bottom of the boiler. Such an arrangement is intended to provide a progressive temperature rise from the cold zone of the pump to the hot zone, and is intended to cause the thermal switch to respond to temperature changes in either the cold zone or the hot zone, so that it will be sensitive to any of the malfunctions described above. However, the provision of such an elongated thermal conductor, connected at one end to the boiler plate and at the other end to the cooling coils, provides a direct heat conductive path from the hot zone to the cold zone of the pump, and impairs to a large extent the efficiency of the pump. Also, the mounting of the thermal switch on such a conductor means that the switch must operate at relatively high temperature levels.

The system of the present invention is similar in some respects to the system described in the patent, in that a thermal switch is mounted on a bracket attached at one end to the cooling coils of the pump. However, in the system of the invention, the other end of the bracket, instead of being connected to the boiler plate at the bottom of the boiler, is displaced from the heating block containing the heater, and is heated by radiation and convection from the heater block, so as to minimize the direct transfer of heat from the hot zone to the cold zone of the pump, and also to permit the thermal switch to operate at relatively low temperature levels.

Thus, the system of the invention protects the diffusion pump from loss of water cooling as well as from overheating of the heater, without significantly adversely affecting the normal efficiency of the pump, and by permitting the thermal switch to operate at efficient temperature levels, for example, 260° F. range, as compared with a 600° F. range of the switch in the system of the patent. The thermal switch used in the system of the invention is conductively cooled through its contact through the bracket to the cooling coils of the pump, and it is heated by radiation and convection from the heater. Therefore, overheating of the heater for any reason causes the thermal switch to open, and loss of water cooling will also cause the thermal switch to open, thereby preventing damage of the pump due to any malfunction.

The system of the invention is also useful in conjunction with apparatus other than diffusion pumps, such as distilling apparatus and the like.

The primary purpose of the protective system of the invention, when used in conjunction with a diffusion pump, is to prevent overheating of the heater upon loss of pumping fluid within the pump. In normal operation of the pump, the pumping fluid is vaporized through a jet structure within the containment vessel, and heat is removed from the bottom of the vessel by the transfer of the fluid in vapor form to the cooled walls of the vessels where it is condensed and returned to the boiler at the bottom of the containment vessel.

As mentioned above, the protective system of the invention has additional structural features which, together with the structure described briefly above, will be described in detail in the following specification.

DETAILED DESCRIPTION OF THE ILLUSTRATED EMBODIMENT

Figures 1, 5:
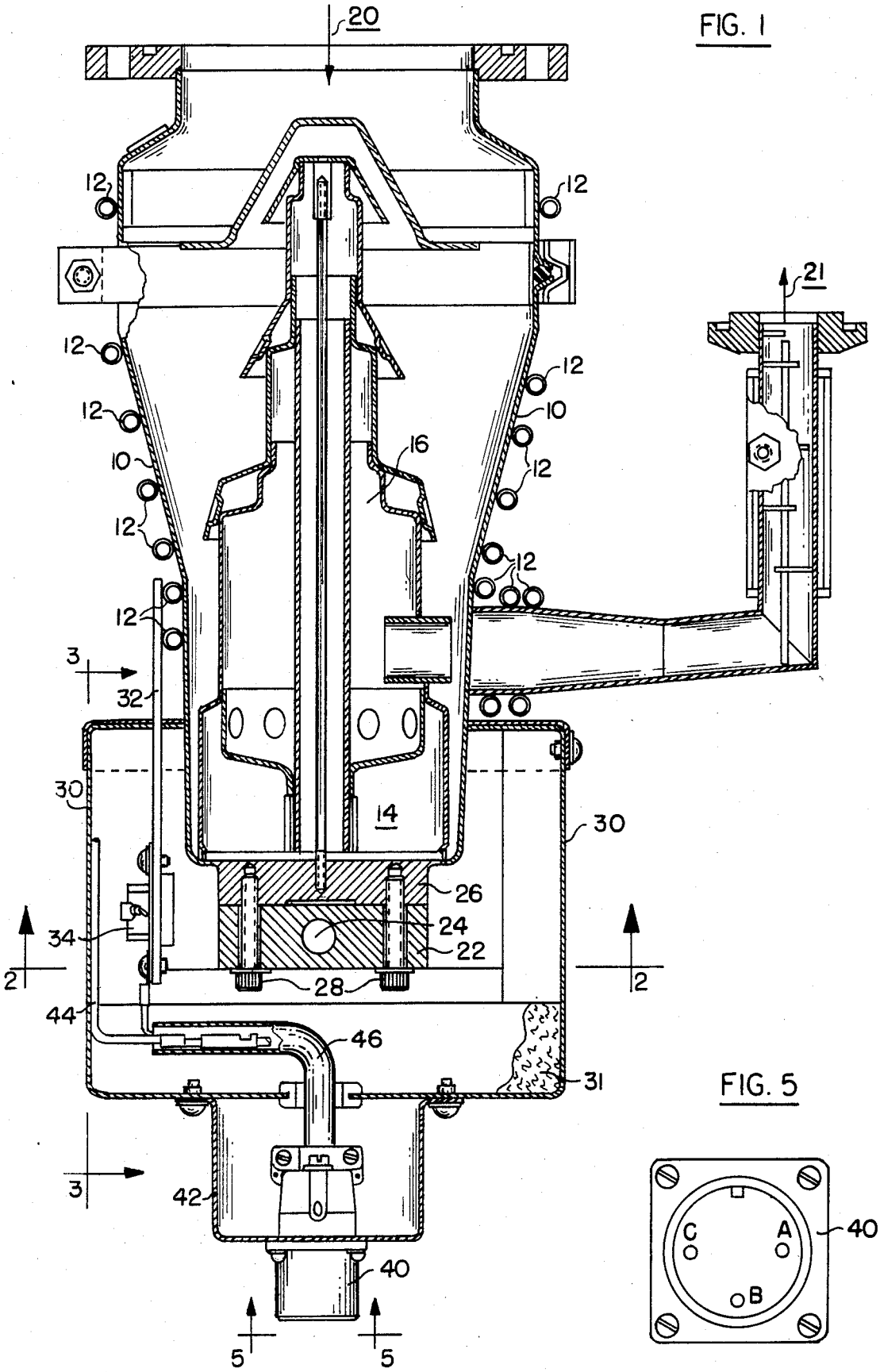
FIG. 1 is a side section of a diffusion pump which incorporates a protective system constructed in accordance with one embodiment of the invention.
FIG. 5 is a view of an electric socket at the bottom of the pump of FIG. 1, taken essentially along the line 5—5 of FIG. 1.
Figure 3:
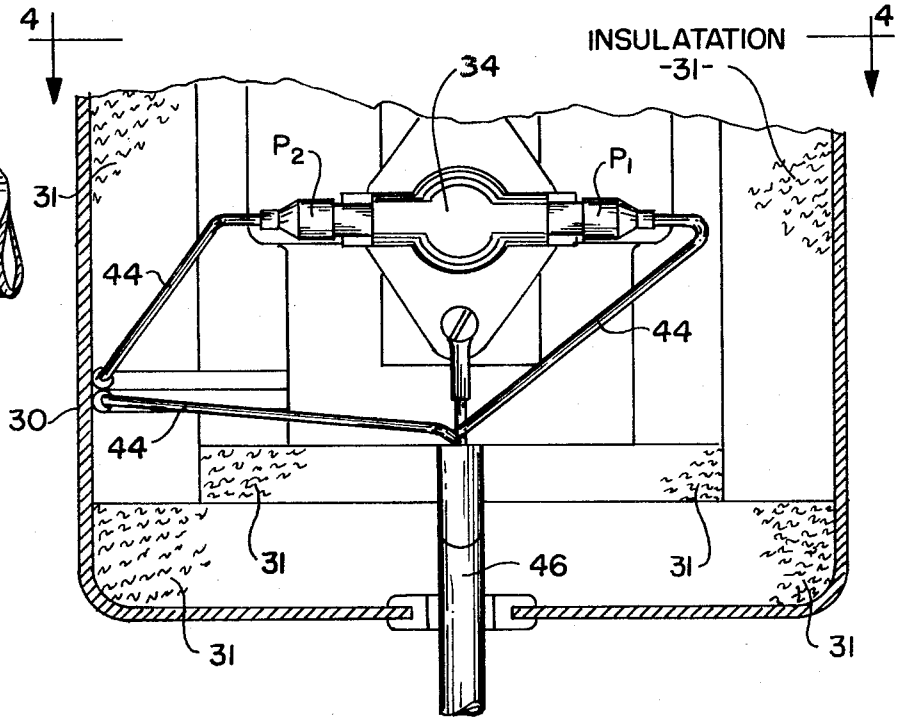
FIG. 3 is a sectional view of the pump of FIG. 1, taken essentially along the line 3—3 of FIG. 1.
Figure 2:
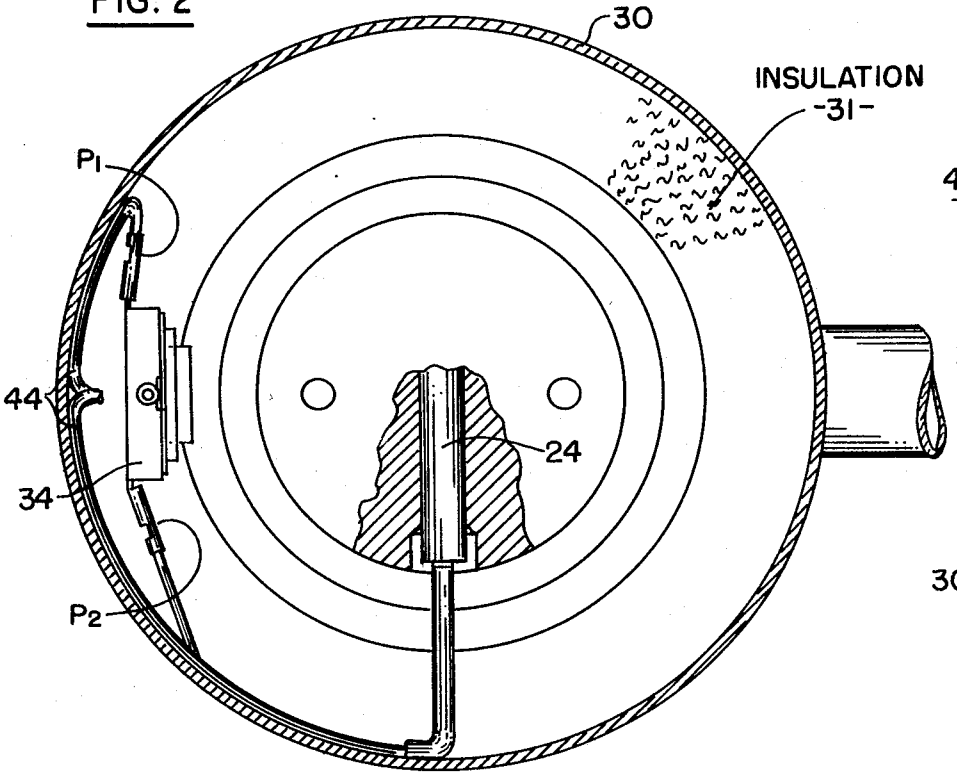
FIG. 2 is a section of the pump of FIG. 1 taken essentially along the line 2—2 of FIG. 1.

As shown the drawings, the diffusion pump includes a containment vessel 10, the upper portion of which is surrounded by tubular members 12 through which cooling water is circulated; and the lower portion of which forms a boiler 14. A vapor jet assembly 16 is mounted within the containment vessel which provides a multiplicity of jets. The boiler vaporizes the pumping fluid (oil or mercury) and supplies pumping vapors to the interior of the jet assembly. The pumping fluid, such as oil or mercury, is heated in the boiler 14 and vaporized, and the vaporized fluid is emitted through jets in the assembly 16 to the wall of the vessel 10, at which the pumping fluid is condensed and returned to the boiler. The vapor jet assembly may, for example, be of the type illustrated and described in U.S. Pat. No. 3,363,830. The foregoing action draws gas in through an inlet 20 at the upper end of the containment vessel, and causes the gas to be discharged through an exit port 21, creating a vacuum within the container above the pump (not shown) which is coupled to the inlet 20.

An electrically energized heater 24 is contained within a heater block 22, the heater block being formed of heat conductive material. The heater block 22 is mounted to a boiler plate 26 at the bottom of boiler 14 this being achieved by screws, such as screws 28. The heater block is, preferably, formed of a material having a relatively low melting point, such as aluminum, so that should the heater 24 become overheated, the heater block 22 will melt, and will draw back from the boiler plate 26, thereby preventing the boiler 14 itself from becoming overheated.

Figure 6:
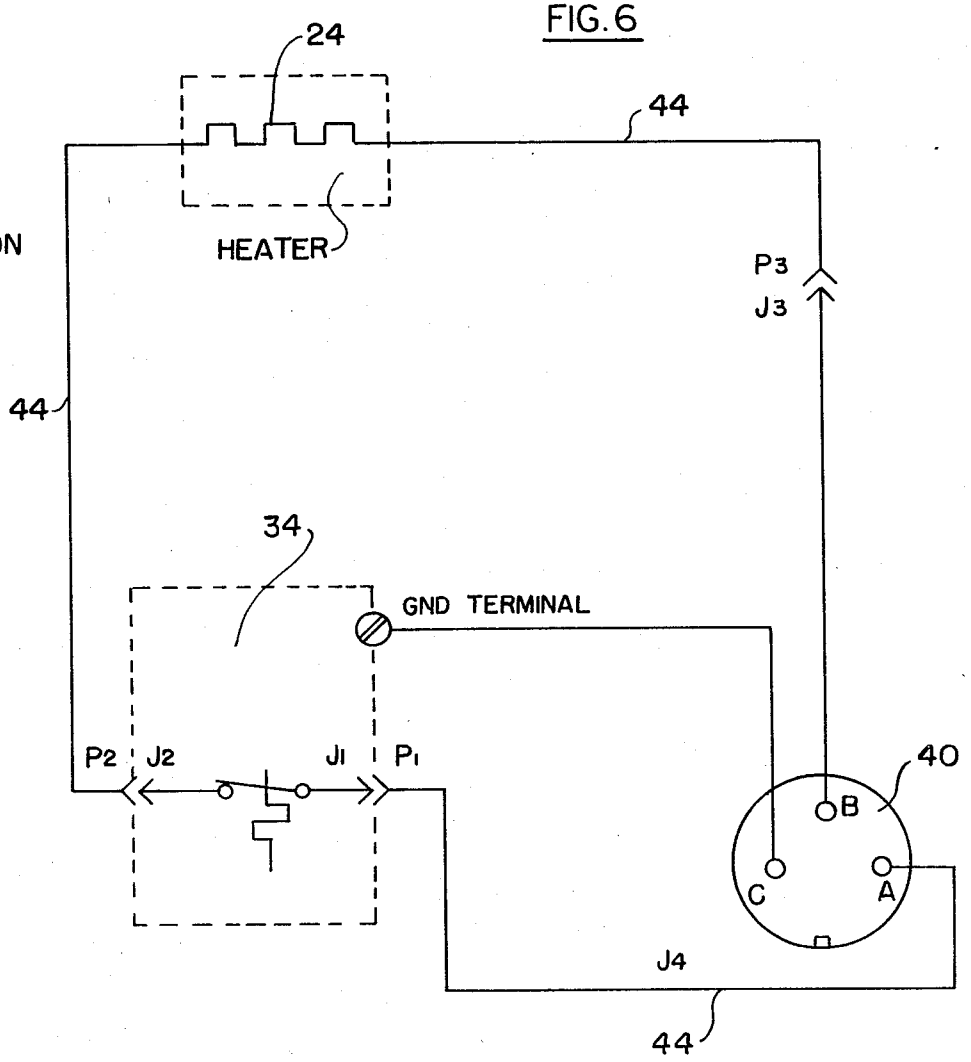
FIG. 6 is a schematic representation of the electrical circuitry through a thermal switch to an electric heater which is included in the pump assembly.
Figure 4:
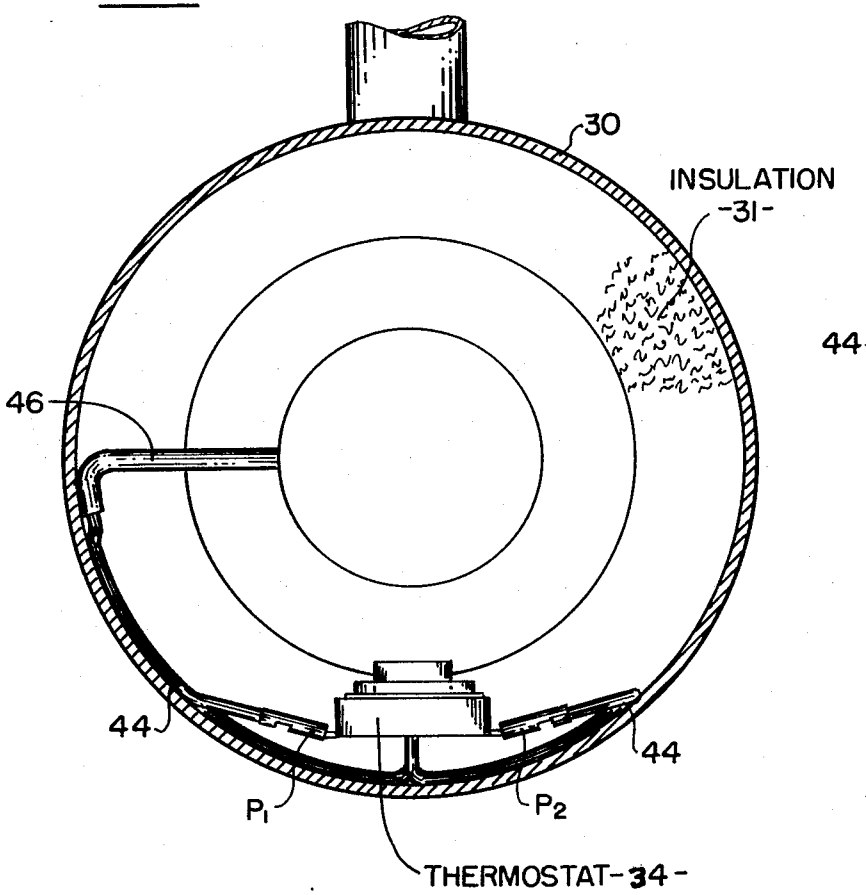
FIG. 4 is a cross-sectional view taken essentially along the line 4—4 of FIG. 3.

The boiler 14 and the heater 24 and heater block 22 are enclosed within a second vessel 30 which is filled with appropriate heat insulating material, such as represented as 31. An elongated bracket 32, formed of appropriate heat conductive material, such as brass, is affixed at one end to the lowermost cooling water tubular members 12, and it extends into the vessel 30. The lower end of bracket 32 is spaced from the heater block 22, as shown. A thermal-responsive switch 34 is mounted on bracket 32 in the illustrated position, and the switch responds to a rise in temperature in the cooling water in tubular members 12, as conducted to the switch by bracket 32, and the switch also responds to a rise in the temperature of the heater block 22, as the heat is radiated or convected to the bracket through the vessel 30. Electrical connections to the heater 24 are made through a socket 40 which is mounted in a compartment 42 affixed to the underside of vessel 30. Electrical conductors 44 for the heater extend through a fiberglass tube 46, and are connected through switch 34 in a circuit shown, for example, in FIG. 6.

As mentioned above, the thermal switch 34 is conduction cooled through its contact with bracket 32 which, in turn, contacts the tubular members 12; and the thermal switch is heated by radiation and convection from heater block 22. Under normal operation an equilibrium temperature of, for example, 260° F. is achieved at the switch, as mentioned above.

Overheating of heater 24 for any reason will cause the thermal switch 34 to open, and de-energize the heater. Loss of water cooling through the tubular members 12 will also cause the thermal switch to open. As also mentioned, the primary purpose of the protection system in use on the diffusion pump is to prevent overheating of the heater 24 upon loss of the pumping fluid within the pump.

As also explained above, another feature of the assembly of the invention is that the heater block 22 which incorporates the heater 24 is made of low melting temperature material, such as aluminum. Then, if there is a failure of the protective system itself, overheating of the heater will soften or melt the heater block pulling it away from the boiler plate 26 thereby reducing heat transfer to the pump and preventing overheating and damage to the pump containment vessel 10.

A third feature of the pump is in its design to minimize the power requirements needed for good pump operation. The lower portion of the containment vessel 10, which contains the boiler 14 is surrounded by the insulation 31 contained in vessel 30. Also, the portion of the wall of the containment vessel 10 surrounding the boiler has a relatively thin cross-section and is fabricated from a low thermally conductive material, such as stainless steel, thus minimizing heat transfer from the heater 24 to the cooling coils. Also, since the thermal conductive bracket 32 makes no physical contact with the heater 24 or heater block 22, heat transferred to the cooling water tubular members 12 is further minimized.

It will be appreciated that although a particular embodiment of the invention has been shown and described, modifications may be made. It is intended in the claims to cover all such modifications as come within the true spirit and scope of the invention.

What is claimed is:

1. In a diffusion pump, and the like, which includes a containment vessel having a tubular wall, a boiler mounted at the bottom of the containment vessel for vaporizing a working fluid within the vessel, and means for cooling the tubular wall of the containment vessel above the boiler to condense the vapor of the working fluid, the combination of: heater means mounted adjacent to said boiler; a thermally conductive bracket attached at one end to said cooling means and having its other end extending into spaced relationship with said heater means to be heated by conduction from the cooling means and to be heated by radiation from the heater means; electrical circuitry for supplying electric current to the heater means; and a thermally responsive switch mounted on said bracket to de-energize the heater means when the temperature of the bracket at the point of contact with the switch rises above a predetermined level.

2. The combination defined in claim 1, in which said heater means includes a heater block of thermally conductive material attached to the boiler, and an electrically energized heating element mounted within the block.

3. The combination defined in claim 1, and which includes a second vessel surrounding the boiler and the heater means, and in which said bracket extends into said second vessel.

4. The combination defined in claim 2, in which said heater block is formed of a material of relatively low melting point as compared with the material of the containment vessel so that overheating of the heating element will cause the heater block to melt and pull away from the boiler.

5. The combination defined in claim 3, in which said second vessel is filled with thermal insulating material to minimize the heat transfer from the heater means to the cooling means.

6. The combination defined in claim 1, in which the portion of the wall of the containment vessel surrounding said boiler is formed of relatively thin low thermally conductive material to minimize heat transfer from said heater means to said cooling means.

7. The combination defined in claim 1, in which said cooling means comprises tubular members surrounding said containment vessel in contact therewith, and in which said thermally conductive bracket has an elongated configuration and is affixed at one end to the lowermost ones of said tubular members.

* * * * *